US011753266B2

(12) United States Patent
Midorikawa

(10) Patent No.: US 11,753,266 B2
(45) **Date of Patent: *Sep. 12, 2023**

(54) SHEET STACKING DEVICE AND IMAGE FORMING APPARATUS INCORPORATING THE SHEET STACKING DEVICE

(71) Applicant: Ruki Midorikawa, Kanagawa (JP)

(72) Inventor: Ruki Midorikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

This patent is subject to a terminal disclaimer.

(21) Appl. No.: 17/131,982

(22) Filed: Dec. 23, 2020

(65) Prior Publication Data

US 2021/0107758 A1 Apr. 15, 2021

Related U.S. Application Data

(63) Continuation of application No. 16/253,432, filed on Jan. 22, 2019, now Pat. No. 10,906,765.

(30) Foreign Application Priority Data

Feb. 14, 2018 (JP) ..... 2018-024385

(51) Int. Cl.
*B65H 29/24* (2006.01)
*B65H 43/06* (2006.01)
(Continued)

(52) U.S. Cl.
CPC ..... *B65H 29/246* (2013.01); *B65H 43/06* (2013.01); *G03G 15/6552* (2013.01); *G03G 21/206* (2013.01); *B65H 2301/5144* (2013.01); *B65H 2511/15* (2013.01); *B65H 2553/61* (2013.01); *B65H 2601/273* (2013.01); *G03G 2215/00911* (2013.01)

(58) Field of Classification Search
CPC ..... B65H 31/16; B65H 29/246; B65H 2601/273; B65H 2301/5144; G03G 21/206
See application file for complete search history.

(56) References Cited

U.S. PATENT DOCUMENTS 5,008,716 A 4/1991 Onose et al.
5,324,024 A * 6/1994 Mori ..... B65H 29/246 271/211
(Continued)

FOREIGN PATENT DOCUMENTS

DE 4012943 A1 * 10/1991 ..... B65H 29/246
JP H4372941 A 12/1992
(Continued)

OTHER PUBLICATIONS

JP Office Action for corresponding Japanese Patent Application No. 2018-024385 dated Sep. 21, 2021.

*Primary Examiner* — Patrick Cicchino
(74) *Attorney, Agent, or Firm* — Harness, Dickey & Pierce, P.L.C.

(57) ABSTRACT

A sheet stacking device includes a stacker, a detector, a blower, and a moving device. A sheet is stacked on the stacker. The detector detects a stacking amount of the sheet on the stacker. The blower blows air to the sheet stacked on the stacker. The moving device moves the blower with respect to the stacker based on the stacking amount of the sheet detected by the detector.

20 Claims, 9 Drawing Sheets

(51) Int. Cl.
*G03G 15/00* (2006.01)
*G03G 21/20* (2006.01)

(56) References Cited

U.S. PATENT DOCUMENTS

| | | | | |
|---|---|---|---|---|
| 6,731,886 | B2 * | 5/2004 | Takeda | B65H 7/02 399/45 |
| 7,014,183 | B2 * | 3/2006 | Tamura | B65H 33/08 271/220 |
| 8,045,914 | B2 * | 10/2011 | Kato | G03G 15/6573 399/401 |
| 9,085,436 | B2 * | 7/2015 | Suzuki | B65H 31/26 |
| 10,894,684 | B2 * | 1/2021 | Okada | G03G 15/6573 |
| 10,906,765 | B2 * | 2/2021 | Midorikawa | G03G 21/206 |
| 11,084,679 | B2 * | 8/2021 | Tsuchiya | B65H 31/38 |
| 11,208,286 | B2 * | 12/2021 | Morita | B65H 31/02 |
| 2002/0158405 | A1 * | 10/2002 | Nagasako | B65H 31/10 271/220 |

FOREIGN PATENT DOCUMENTS

| | | | |
|---|---|---|---|
| JP | 2008134484 | A | 6/2008 |
| JP | 2011051676 | A | 3/2011 |
| JP | 2016-212162 | A | 12/2016 |

* cited by examiner

SHEET STACKING DEVICE AND IMAGE FORMING APPARATUS INCORPORATING THE SHEET STACKING DEVICE

CROSS-REFERENCE TO RELATED APPLICATION

The present application is a continuation of, and claims the benefit of priority under 35 U.S.C. § 120 to U.S. patent application Ser. No. 16/253,432, filed on Jan. 22, 2019, which claims the benefit of priority under 35 U.S.C. § 119(a) to Japanese Patent Application No. 2018-024385, filed on Feb. 14, 2018, in the Japan Patent Office, the entire disclosure of each of which are incorporated by reference herein.

BACKGROUND

Technical Field

This disclosure relates to a sheet stacking device and an image forming apparatus incorporating the sheet stacking device.

Related Art

An image forming apparatus using an electrophotographic method heats a sheet to fix an image on the sheet, and thus, the temperature of the sheet immediately after being ejected is high. Stacking these sheets at the high temperature onto a sheet ejection tray would lead to a phenomenon referred to as blocking in which the ejected sheets stick to each other due to the melted toner in some cases.

In order to overcome such a disadvantage, a technique of cooling the sheet ejected to the sheet ejection tray by using a cooling fan has been proposed.

In such a technique, setting the cooling fan at a distance separated too far from the ejected sheet would reduce the cooling effect, and in order to avoid this, the cooling fan is often installed in a secured state at a position close to the sheet.

On the other hand, in a case in which a large number of sheets are stacked on the sheet ejection tray, setting the sheet and the cooling fan close to each other would lead to another disadvantage that when the user using the image forming apparatus removes the sheet, the cooling fan hinders the operation such that the sheet or the hand of an operator or a user hit the cooling fan.

SUMMARY

At least one aspect of this disclosure provides a sheet stacking device including a stacker, a detector, a blower, and a moving device. A sheet is stacked on the stacker. The detector detects a stacking amount of the sheet on the stacker. The blower blows air to the sheet stacked on the stacker. The moving device moves the blower with respect to the stacker based on the stacking amount of the sheet detected by the detector.

Further, at least one aspect of this disclosure provides a fixing device to fix an image on a sheet, and the above-described sheet stacking device. The sheet to which the image has been fixed by the fixing device is stacked on the stacker.

BRIEF DESCRIPTION OF THE DRAWINGS

The aforementioned and other aspects, features, and advantages of this disclosure would be better understood by reference to the following detailed description when considered in connection with the accompanying drawings, wherein.

Figure 1:
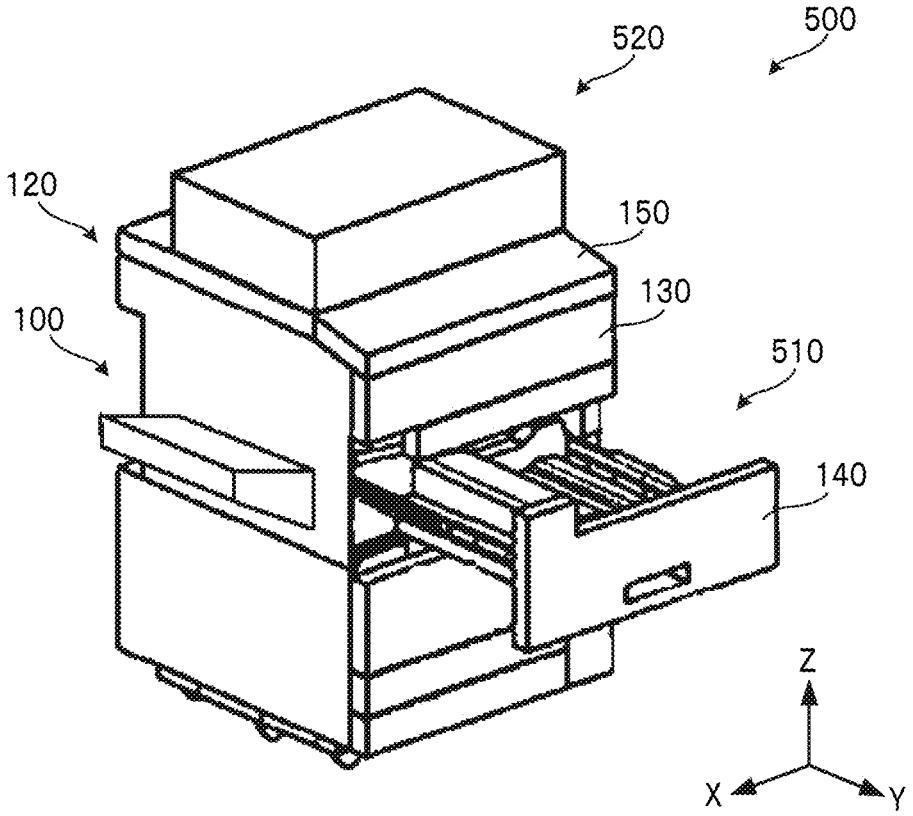
FIG. 1 is a perspective view of an example of an image forming apparatus including a sheet stacking device according to this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of this disclosure.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, embodiments of this disclosure are described below. In the drawings for explaining the following embodiments, the same reference codes are allocated to elements (members or components) having the same function or shape and redundant descriptions thereof are omitted below.

Figure 2:
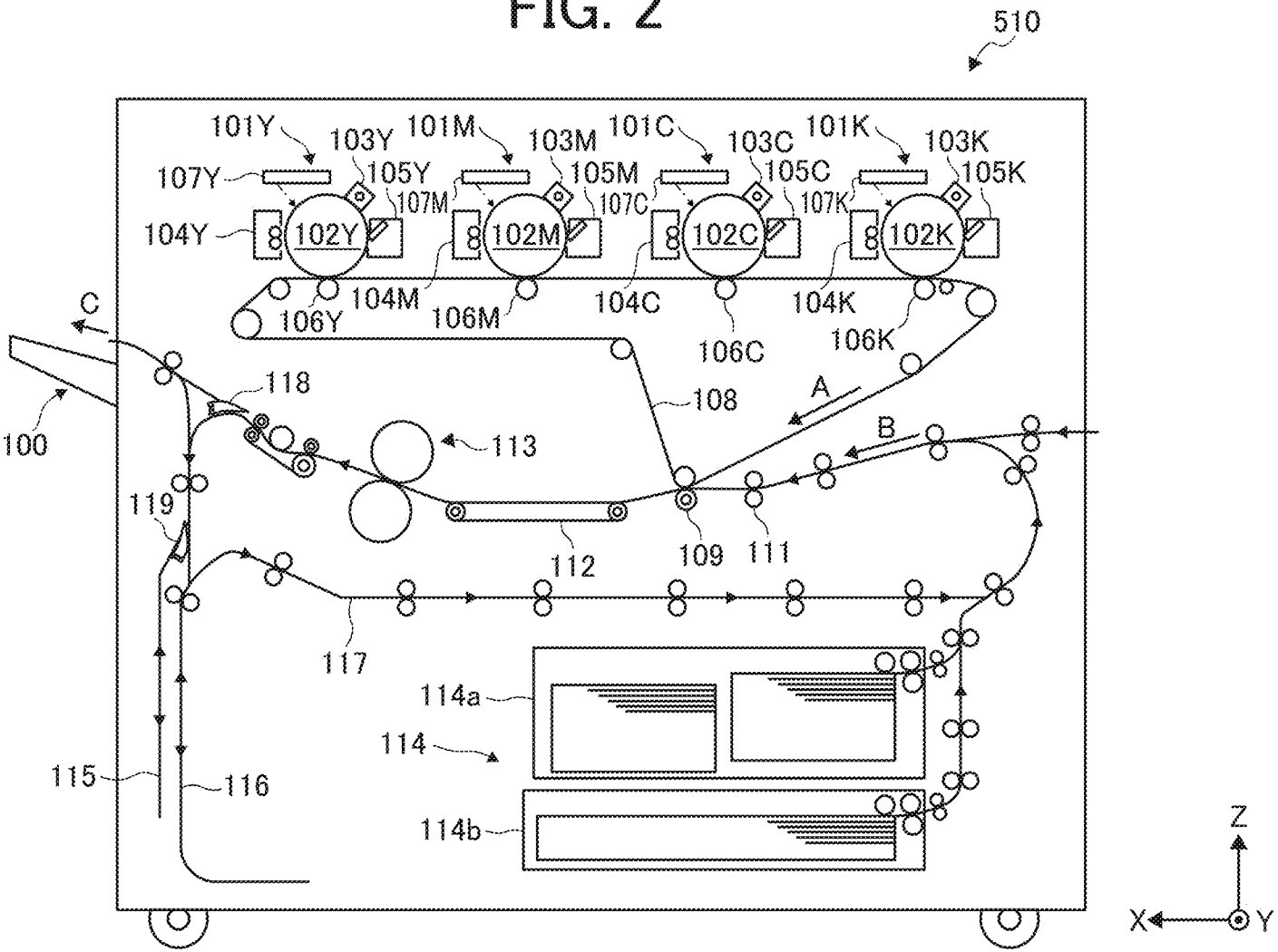
FIG. 2 is a schematic view illustrating an internal structure of an image forming apparatus main body illustrated in FIG. 1.

FIG. 1 illustrates an example of an image forming apparatus 500 including a sheet ejection device 100 that functions as a sheet stacking device according to this disclosure. FIG. 2 illustrates an internal structure of an image forming apparatus main body 510.

The image forming apparatus 500 may be a copier, a facsimile machine, a printer, a multifunction peripheral or a multifunction printer (MFP) having at least one of copying, printing, scanning, facsimile, and plotter functions, or the like. According to the present example, the image forming apparatus 500 is a printer or a copier that forms images on recording media by supplying toner.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1 and the subsequent figures, an X-direction indicated by arrow X represents a left-right direction of the image forming apparatus 500, a Y-direction indicated by arrow Y represents a front-rear direction of the image forming apparatus 500, a Z-direction indicated by arrow Z represents an up-down direction of the image forming apparatus 500.

As illustrated in FIG. 1, the image forming apparatus 500 includes the image forming apparatus main body 510 and an automatic document feeder (ADF) 520 provided above the image forming apparatus main body 510.

This image forming apparatus 500 is a full color printer using toner of four colors of yellow (Y), cyan (C), magenta (M), and black (K) and a full color copier having an equivalent image formation function.

As illustrated in FIG. 2, the image forming apparatus main body 510 includes four image forming units 101Y, 101M, 101C, and 101K arranged in an upper portion to perform image formation with toner of individual colors. Since configuration and operation of each of the image forming units 101Y, 101M, 101C, and 101K are substantially the same, signs (Y, M, C, and K) representing the colors will be occasionally omitted in the description of the image forming unit 101.

The image forming units 101Y, 101M, 101C, and 101K include respective photoconductor drums 102Y, 102M, 102C, and 102K (occasionally in a singular form, for example, a photoconductor drum 102), each functioning as an image bearer, respective charging devices 103Y, 103M, 103C, and 103K (occasionally in a singular form, for example, a charging device 103), respective developing devices 104Y, 104M, 104C, and 104K (occasionally in a singular form, for example, a developing device 104), respective cleaning devices 105Y, 105M, 105C, and 105K (occasionally in a singular form, for example, a cleaning device 105). The charging device 103, the developing device 104, and the cleaning device 105 are disposed around the photoconductor drum 102. The image forming units 101Y, 101M, 101C, and 101K further include respective exposure devices 107Y, 107M, 107C, and 107K (occasionally in a singular form, for example, an exposure device 107). The exposure device 107 is disposed above the corresponding photoconductor drum 102.

The image forming apparatus main body 510 includes an intermediate transfer belt 108 disposed below the four image forming units 101Y, 101M, 101C, and 101K and wound around a plurality of support rollers. The intermediate transfer belt 108 is driven to travel in a direction of arrow A in conjunction with rotational drive of one of the support rollers by a driving unit.

The image forming apparatus main body 510 includes respective transfer rollers 106Y, 106M, 106C, and 106K (occasionally in a singular form, for example, a transfer roller 106) as a primary transfer body arranged so as to face the photoconductor drum 102 of each of the image forming units 101 via the intermediate transfer belt 108.

The image forming apparatus main body 510 includes, at its bottom, a sheet feeding unit 114 equipped with a tandem sheet feed tray 114*a* and a sheet feed tray 114*b*. For example, a sheet S is fed as a sheet from the sheet feeding unit 114.

The image forming apparatus main body 510 includes a secondary transfer roller 109 that comes in contact with the intermediate transfer belt 108 to form a secondary transfer unit.

The image forming apparatus main body 510 includes a fixing device 113 that fixes an image onto the sheet S on which the image has been transferred by the secondary transfer unit.

The image forming apparatus main body 510 includes a sheet ejection device 100 as a sheet stacking device to stack the sheet S on which an image has been fixed by the fixing device 113.

In each of the image forming units 101, the photoconductor drum 102 is rotationally driven counterclockwise in the drawing, and the surface of the photoconductor drum 102 is uniformly charged to a predetermined polarity by the charging device 103. Next, an optically modulated laser beam output from the exposure device 107 is emitted onto the charged surface, so as to form an electrostatic latent image on the photoconductor drum 102. The electrostatic latent image is developed by the toner applied from the developing device 104 and visualized as a toner image. The individual color toner images of yellow, cyan, magenta, and black formed by each of the image forming units 101 are sequentially superimposed and transferred onto the intermediate transfer belt 108.

Meanwhile, the sheet S fed from the sheet feeding unit 114 is conveyed toward the registration roller 111 as indicated by arrow B. The sheet S, which is abutted against the registration roller 111 and temporarily stopped, is delivered from the registration roller 111 in timing with the toner image on the intermediate transfer belt 108, so as to be sent to the secondary transfer unit at which the secondary transfer roller 109 and the intermediate transfer belt 108 come into contact with each other. A voltage having a polarity opposite to the charging polarity of the toner is applied to the secondary transfer roller 109, whereby a superimposed toner image such as a full color image on the intermediate transfer belt 108 is transferred onto the sheet S, for example. The sheet S carrying the transferred toner image is conveyed to the fixing device 113 by a conveyance belt 112, and the toner is fixed on the sheet S by the fixing device 113 by using heat and pressure. The sheet S carrying the transferred toner image passes through a sheet ejection port 511 illustrated in FIG. 3 to be ejected to the outside of the apparatus illustrated by arrow C, that is, outside of the image forming apparatus main body 510 toward the sheet ejection device 100.

When performing back-side sheet ejection that is, face-down sheet ejection with single-sided printing, ejecting the sheet S to the outside of the apparatus through a sheet inverter 115 as indicated by arrow C would reverse the face up/down of the sheet S. When performing duplex printing, the sheet S that has undergone fixation is re-fed from a refeeding path 117 to the registration roller 111 via a duplex inverter 116, and then, the toner image is transferred from the intermediate transfer belt 108 onto the back surface of the sheet S. The sheet S carrying the transferred toner image undergoes fixing on the fixing device 113, and then, similarly to the case of single-sided printing, as indicated by arrow C, the sheet S is ejected from the fixing device 113 via the sheet inverter 115 to be ejected to the sheet ejection device 100, as indicated by arrow C. In order to appropriately switching the conveyance direction of the sheet S, switching claws 118 and 119 are appropriately arranged.

When performing monochrome printing on the image forming apparatus 500 of the present example, a toner image is formed using the black (K) image forming unit 101K alone, and then the toner image is transferred to the sheet S via the intermediate transfer belt 108. The sheet S carrying the transferred toner image is handled similarly to the case of the full color printing.

As illustrated in FIG. 1, the image forming apparatus main body 510 includes an image reader 120 at the top. The image forming apparatus main body 510 further includes a toner supply unit 130 to set each of color toner bottles containing toner to be supplied to the developing device 104 of each of the image forming units 101. The image forming apparatus main body 510 further includes a drawer unit 140 to be drawn out as illustrated in FIG. 1 so as to set the sheet S in the sheet feeding unit 114. The image forming apparatus main body 510 further includes an operation unit 150 having a display unit, an operation panel, or the like.

Figure 3:
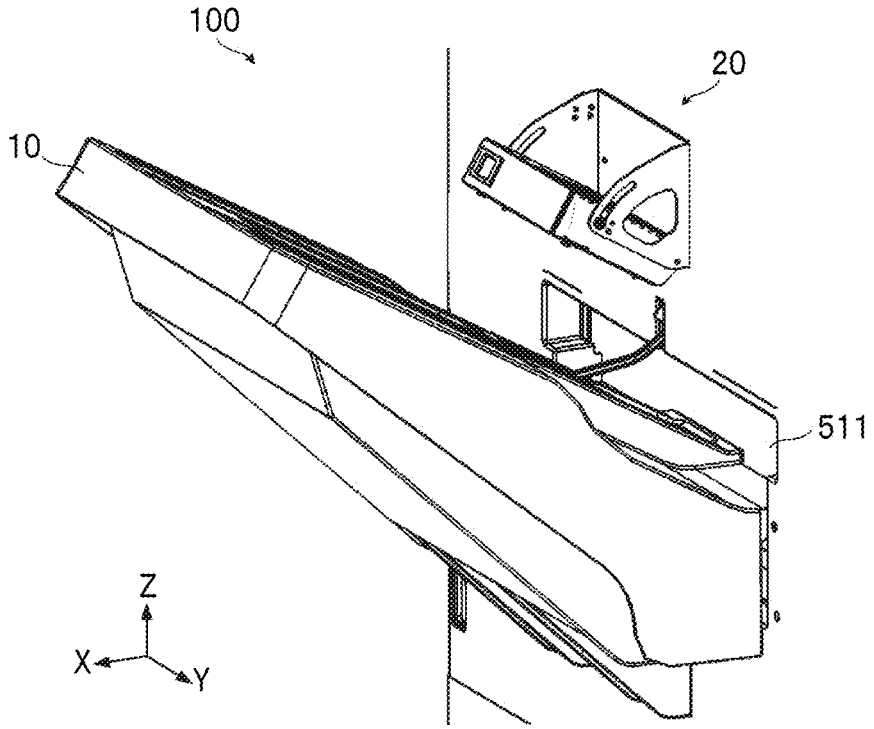
FIG. 3 is a perspective view of an example of a sheet stacking device according to this disclosure.
Figure 4:
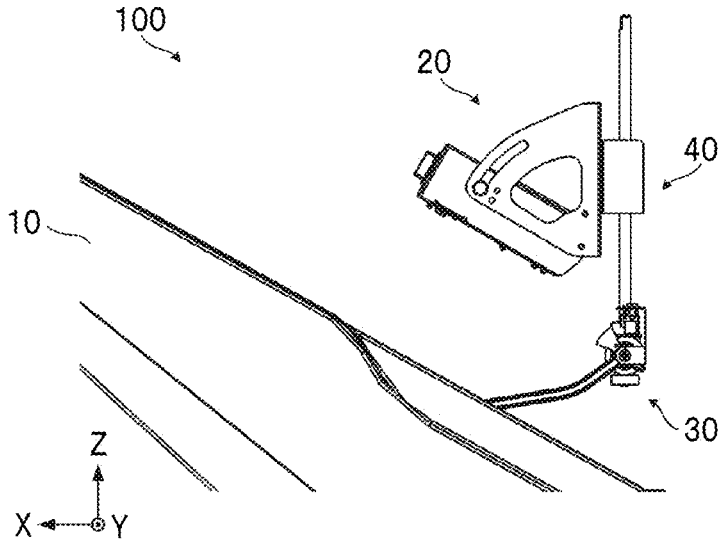
FIG. 4 is a front view illustrating a state in which an outer wall of the image forming apparatus main body has been removed in the sheet stacking device illustrated in FIG. 3.

FIGS. 3 and 4 illustrate an example of the sheet ejection device 100.

As illustrated in FIG. 3 or 4, the sheet ejection device 100 includes a sheet ejection tray 10 as a stacker to stack a bundle of sheets S ejected from the sheet ejection port 511 provided on the outer wall of the image forming apparatus main body 510.

The sheet ejection device 100 includes a blower fan unit 20 positioned above the sheet ejection tray 10, and a detector 30 to detect the stacking amount of the bundle of sheets S on the sheet ejection tray 10.

The sheet ejection device 100 includes a moving mechanism 40 that functions as a moving device to move the blower fan unit 20 with respect to the sheet ejection tray 10 on the basis of the stacking amount of the bundle of sheets S detected by the detector 30.

Figure 5:
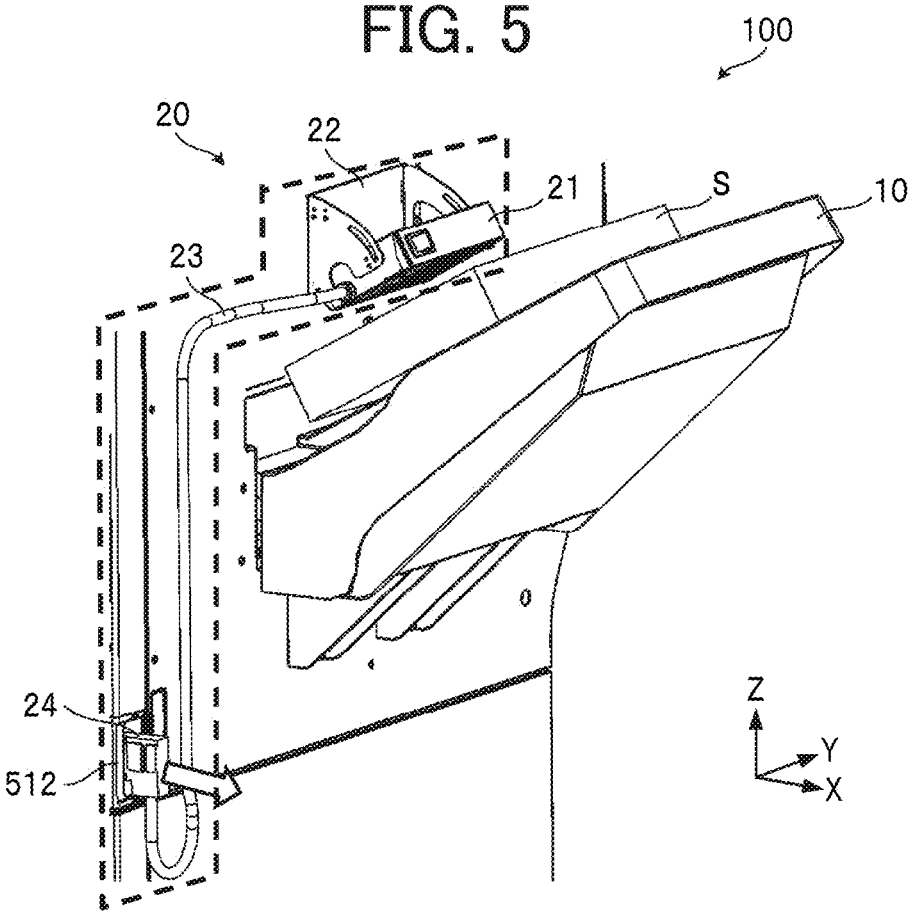
FIG. 5 is a perspective view illustrating connector connection of a blower fan unit provided in the sheet stacking device illustrated in FIG. 3.
Figure 6:
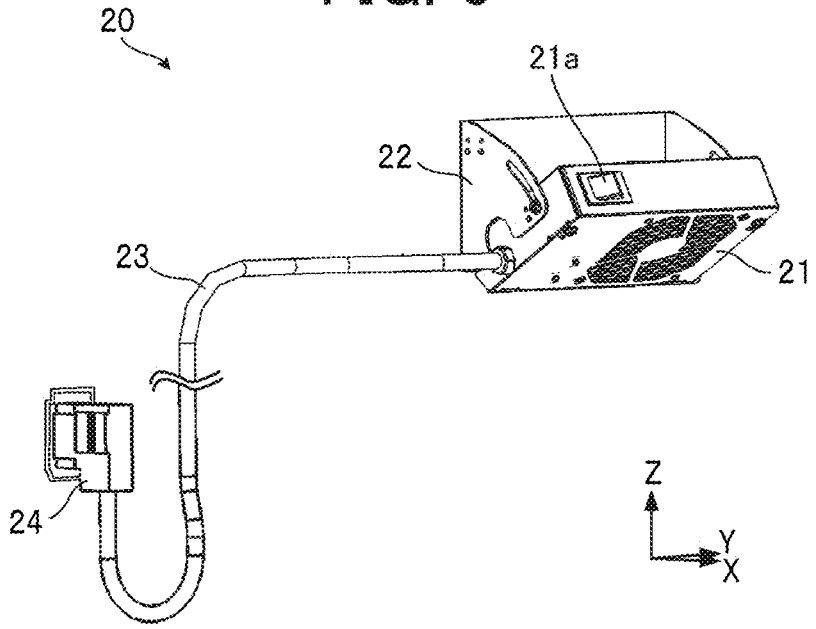
FIG. 6 is a perspective view illustrating a state in which the blower fan unit illustrated in FIG. 5 has been removed from the image forming apparatus.
Figure 7:
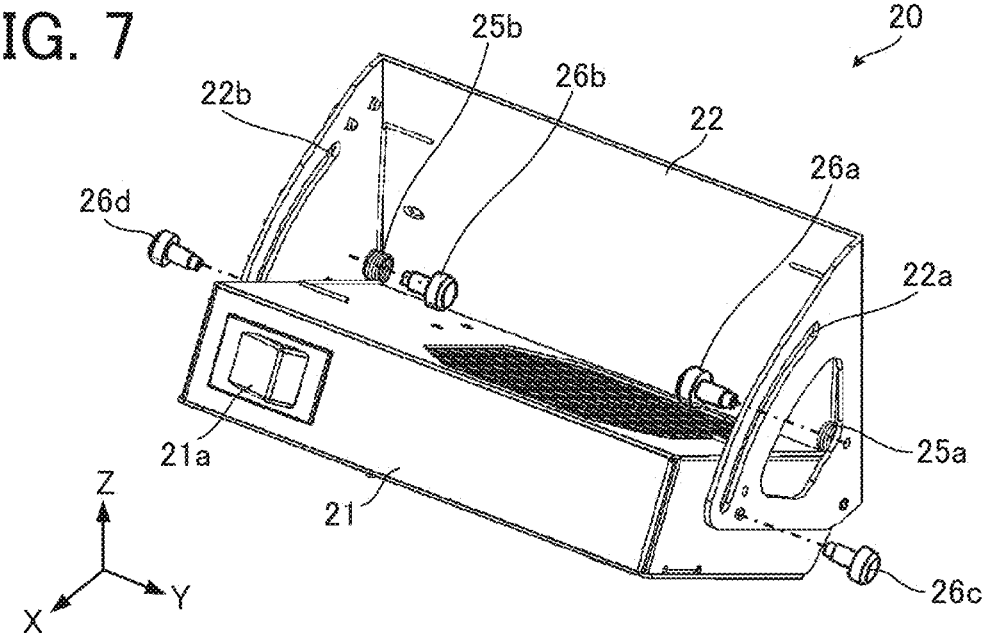
FIG. 7 is an enlarged view of the blower fan unit illustrated in FIG. 5.

FIGS. 5 to 7 illustrate an example of the blower fan unit 20.

As illustrated in FIGS. 5 to 7, the blower fan unit 20 includes a blower fan 21 as a blower to send air to the sheet S stacked on the sheet ejection tray 10.

The blower fan unit 20 has a support 22 to support the blower fan 21 so as to be able to change the distance from the sheet ejection tray 10.

The blower fan unit 20 includes a cable 23 to supply power from the image forming apparatus 500 and to transmit a signal from the image forming apparatus 500 to the blower fan 21, and a connector 24 provided at the leading end portion of the cable 23.

The blower fan unit 20 includes torsion springs 25*a* and 25*b* each of which functioning as a biasing body to bias the blower fan 21 to set the blower fan 21 to the home position.

The blower fan 21 includes a built-in motor. The connector 24 is inserted into a connector insertion unit 512 provided on the image forming apparatus main body 510 side, and a signal from the image forming apparatus 500 is transmitted to the motor to drive the blower fan 21. The blower fan 21 includes a main power switch 21*a* at its top. The blower fan 21 enables switching power supply ON or OFF of the main power switch 21*a*.

According to the specification, execution of printing in a state in which the connector 24 is not connected to the connector insertion unit 512 leads to occurrence of a service call error, which is to be displayed on the operation unit 150. This is because the image forming apparatus 500 detects disconnection of the connector 24 as a rotation malfunction of the blower fan 21.

Figure 8:
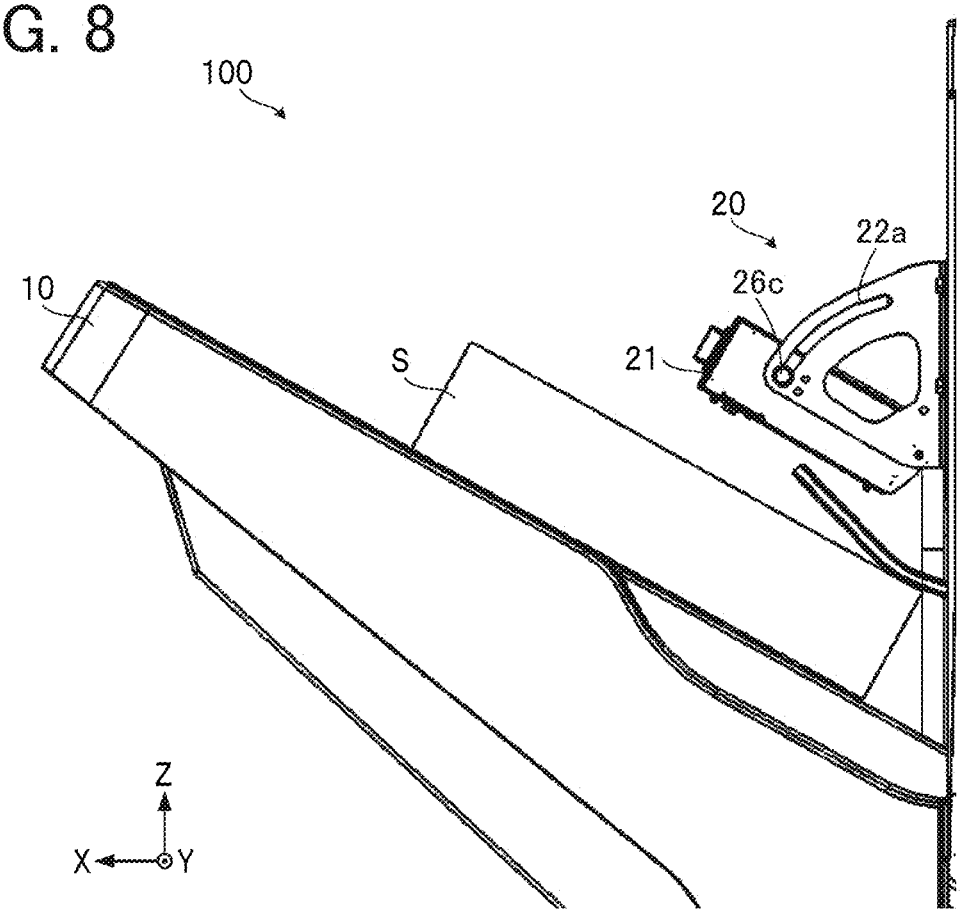
FIG. 8 is a front view illustrating a state in which a blower provided in a blower fan unit is set in a home position.

The torsion springs 25*a* and 25*b* are positioned between the blower fan 21 and the support 22 and are attached to the support 22 by shoulder screws 26*a* and 26*b*. As illustrated in FIG. 8, the torsion springs 25*a* and 25*b* apply constant stress to the blower fan 21 and the support 22.

Figure 9:
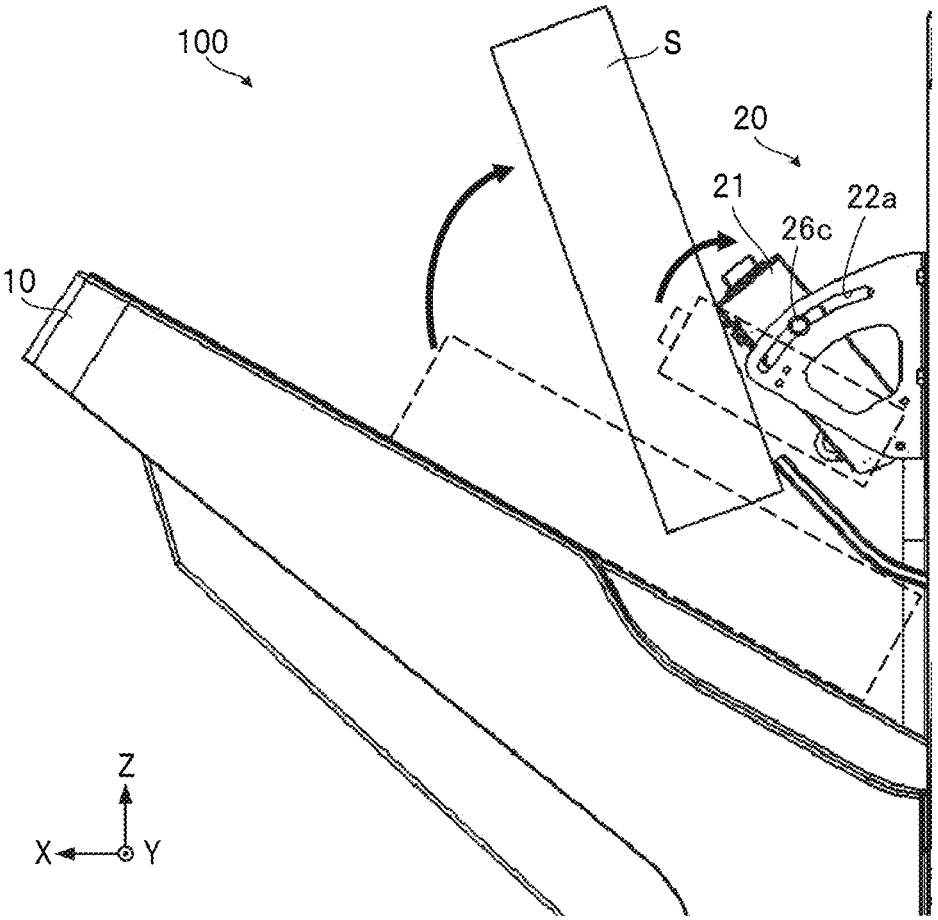
FIG. 9 is a front view illustrating a state in which the blower is withdrawn from the state illustrated in FIG. 8.

As illustrated in FIG. 7, the support 22 has grooves 22*a* and 22*b* for changing the blowing angle of the blower fan 21 with respect to the bundle of sheets S stacked on the sheet ejection tray 10. The state in which the shoulder screws 26*c* and 26*d* illustrated in FIG. 8 are respectively in the lower limit positions of the grooves 22*a* and 22*b* is the state in which the blower fan 21 is set to the home position. As illustrated in FIG. 9, when impact caused by a sheet S or the hand of an operator or a user is applied to the blower fan 21, the shoulder screws 26*c* and 26*d* attached to the blower fan 21 move along the grooves 22*a* and 22*b* respectively, so as to rotate the blower fan 21 about a lower portion secured to the support 22. At this time, the blower fan 21 is set to a position displaced upward from the home position. When the external force is gone, the blower fan 21 is displaced downward by the elastic force of the torsion springs 25*a* and 25*b* and returns to the home position.

While the present embodiment has a configuration in which the support 22 rotatably supports the blower fan 21, the configuration is not limited to this as long as the blower fan 21 is supported in a state in which the distance of movement of the blower fan 21 is changeable between the blower fan 21 and the sheet ejection tray 10. That is, the support 22 supports the blower fan 21 and allows the blower fan 21 to change the distance of movement of the blower fan 21 between the blower fan 21 and the sheet ejection tray 10. For example, the blower fan 21 may be movably supported in the Z-direction while the blowing angle of the blower fan 21 is maintained at a constant angle.

While the present embodiment uses a torsion coil spring is used as the biasing body, other spring members such as a compression coil spring or a leaf spring may be used, or an elastic body such as a gel or a damper may be inserted between the blower fan 21 and the support 22.

Alternatively, the user may change the blowing angle in a certain angle and secure the blower fan 21 at that angle.

Figure 10:
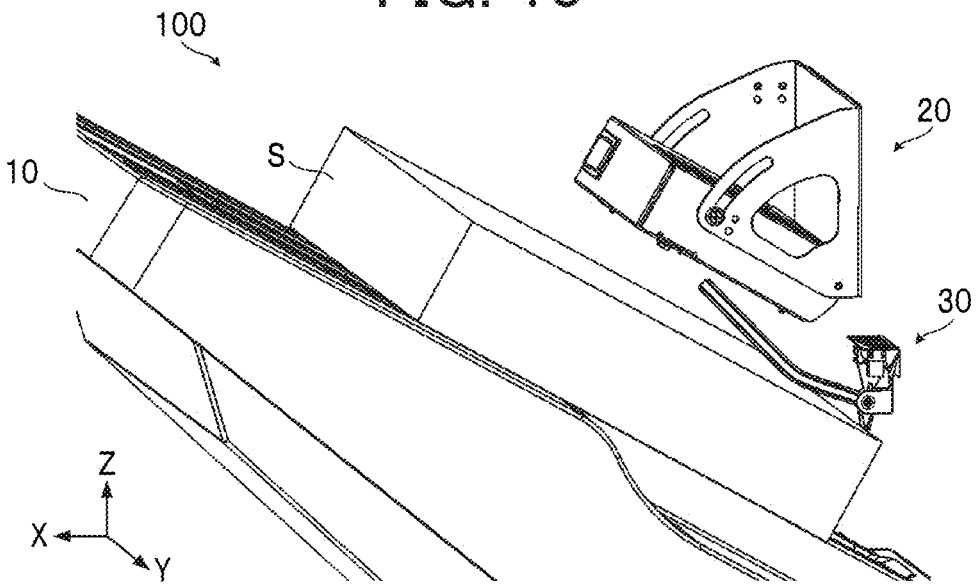
FIG. 10 is a perspective view illustrating a state in which sheets are stacked on a stacker.
Figure 11:
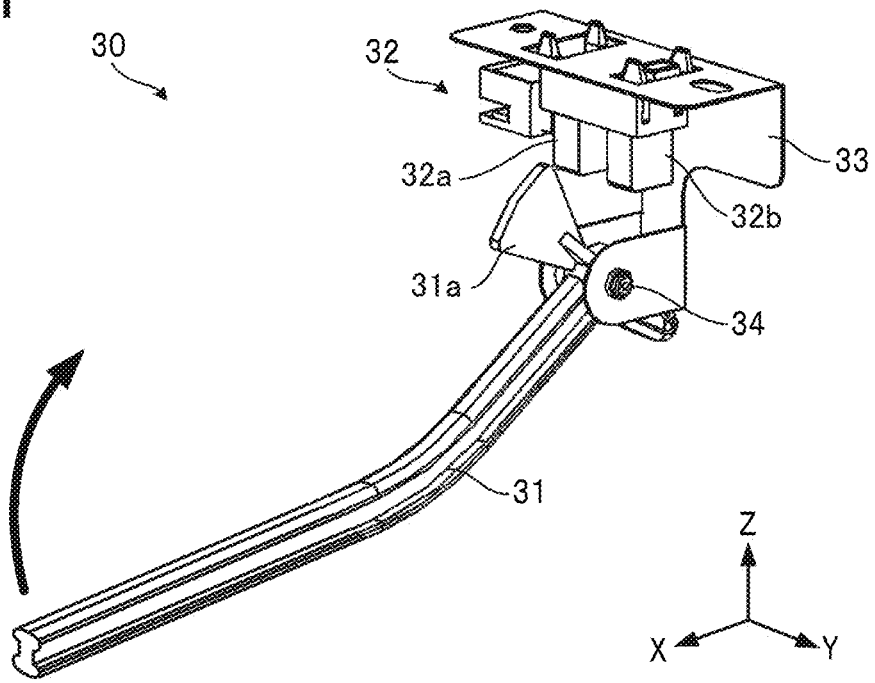
FIG. 11 is a perspective view of a detector provided in the sheet stacking device illustrated in FIG. 4.

FIGS. 10 and 11 illustrate an example of the detector 30.

As illustrated in FIG. 10 or 11, the detector 30 includes a feeler 31 as a displacement body that comes into contact with a top surface of the bundle of sheets S stacked on the sheet ejection tray 10, in other words, an upper face of an uppermost sheet S of the bundle of sheets S, so as to be displaced in accordance with the stacking amount of the bundle of sheets S.

The detector 30 includes a sensor 32 to detect the displacement of the feeler 31.

The detector 30 includes a securing member 33 to secure the feeler 31 and the sensor 32 to the inside of the image forming apparatus main body 510.

With the increase in the stacking amount of the bundle of sheets S on the sheet ejection tray 10, the feeler 31 rotates so that its leading end is displaced upward about a shaft 34.

The sensor 32 is a photointerrupter, that is, a transmission type optical sensor including a light emitter 32*a* and a light receiver 32*b*. When the stacking amount of the bundle of sheet S exceeds a certain amount, an action member 31*a* provided at the base of the feeler 31 reaches the sensor 32 by the rotation of the feeler 31, enters between the light emitter 32*a* and the light receiver 32*b* to block the light from the light emitter 32*a*. With this configuration, the light from the light emitter 32*a* is not detected by the light receiver 32*b* any longer, making it possible to detect that the sheet S is full on the sheet ejection tray 10.

Figure 12:
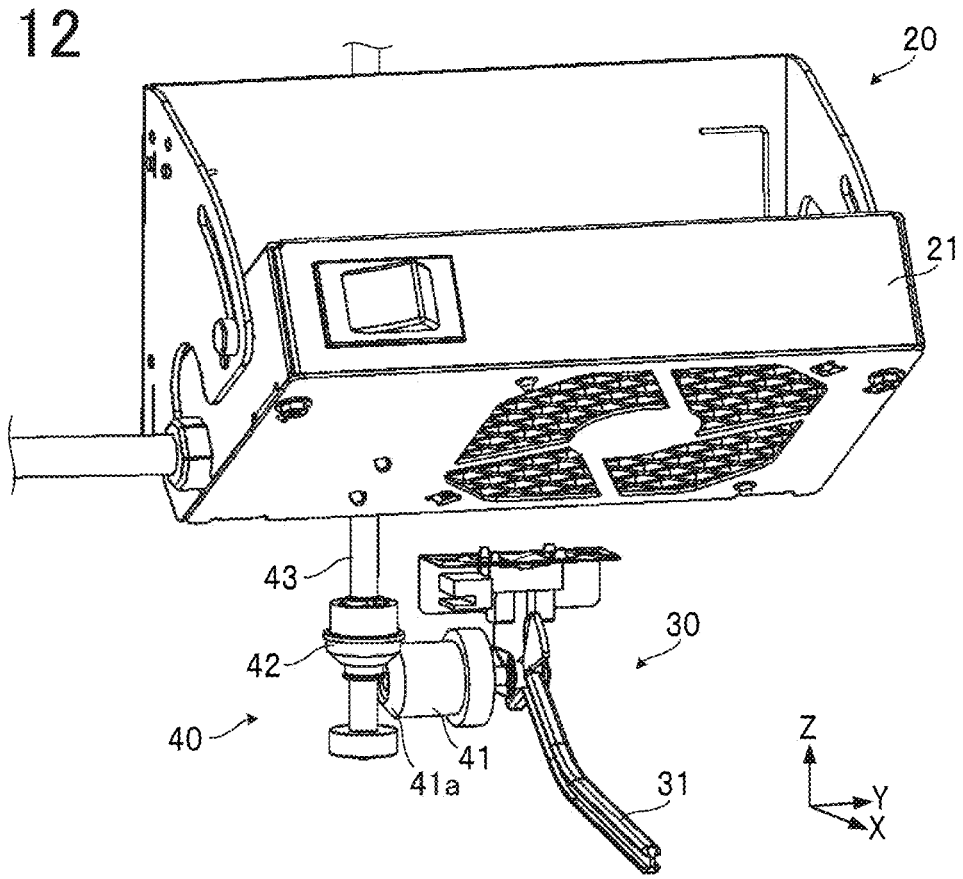
FIG. 12 is a perspective view of a moving mechanism provided in the sheet stacking device illustrated in FIG. 4.
Figure 13:
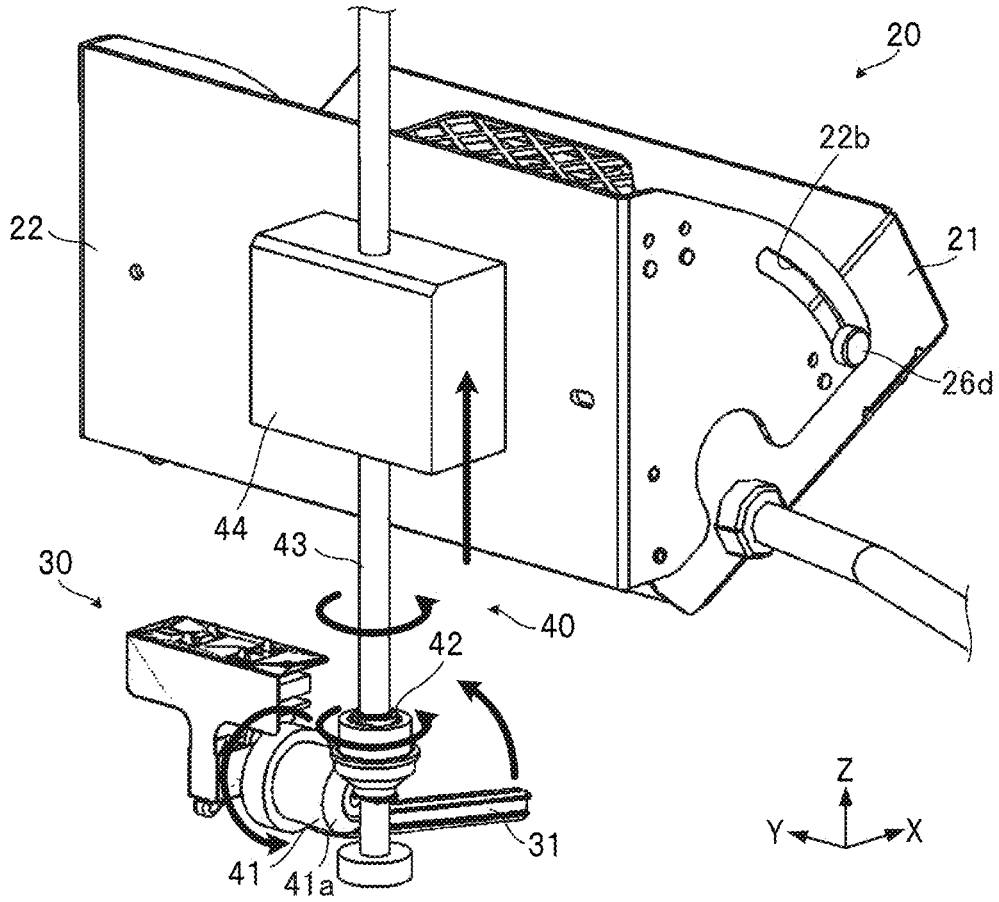
FIG. 13 is a perspective view illustrating operation of the moving mechanism illustrated in FIG. 5.

FIGS. 12 and 13 illustrate an example of the moving mechanism 40.

As illustrated in FIG. 12 or 13, the moving mechanism 40 includes a motor 41 as a drive device that is coupled to the feeler 31 to be switched and driven by displacement of the feeler 31, in other words, according to rotation of the feeler 31.

The moving mechanism 40 includes a driven gear 42 driven by the transmitted rotation of an output gear 41*a* of the motor 41, and a screw 43 driven by the transmitted rotation of the driven gear 42.

The moving mechanism 40 is a member to which the support 22 is secured and including a movable member 44 that moves in the Z-direction by the rotation of the screw 43.

The rotation of the feeler 31 drives the motor 41, so as to rotate the output gear 41*a*. That is, the output gear 41*a* substantially rotates in conjunction with the feeler 31. When the output gear 41*a* rotates, the rotation of the output gear 41*a* is transmitted to the driven gear 42, and the screw 43 is rotated in accordance with the rotation amount transmitted from the driven gear 42.

The movable member 44 has a hole internally tapped so as to be coupled to the screw 43. With this configuration, when the screw 43 rotates, the movable member 44 moves in the Z-direction in conjunction with the rotation of the screw 43. When the movable member 44 moves in the Z-direction, the blower fan unit 20 secured to the movable member 44 also moves in the Z-direction.

Setting the distance between the top surface of the bundle of sheets S stacked on the sheet ejection tray 10 and the blower fan 21 too long would reduce the cooling effect. Accordingly, the moving amount of the blower fan unit 20 is set to achieve a constant distance between the top surface of the sheet S and the blower fan 21.

While the present embodiment has a configuration in which the moving mechanism 40 moves the blower fan unit 20 while maintaining a constant blowing angle of the blower fan 21, this disclosure is not limited to this as long as the blower fan unit 20 is moved with respect to the sheet ejection tray 10. For example, a fulcrum may be provided on the support 22, and the blower fan unit 20 may be rotated in the Y-direction about the fulcrum so that the stacking surface of the sheet S is withdrawn when the stacking amount of the bundle of sheets S increases.

While the present embodiment has a configuration in which the moving mechanism 40 moves the blower fan unit 20 in the up-down direction, this disclosure is not limited to this as long as the blower fan unit 20 is moved with a varying distance from the sheet ejection tray 10. For example, the blower fan unit 20 may be moved in parallel so as to be withdrawn in a direction perpendicular to the stacking surface of the sheet S, in other words, withdrawn in the normal direction.

Figure 15:
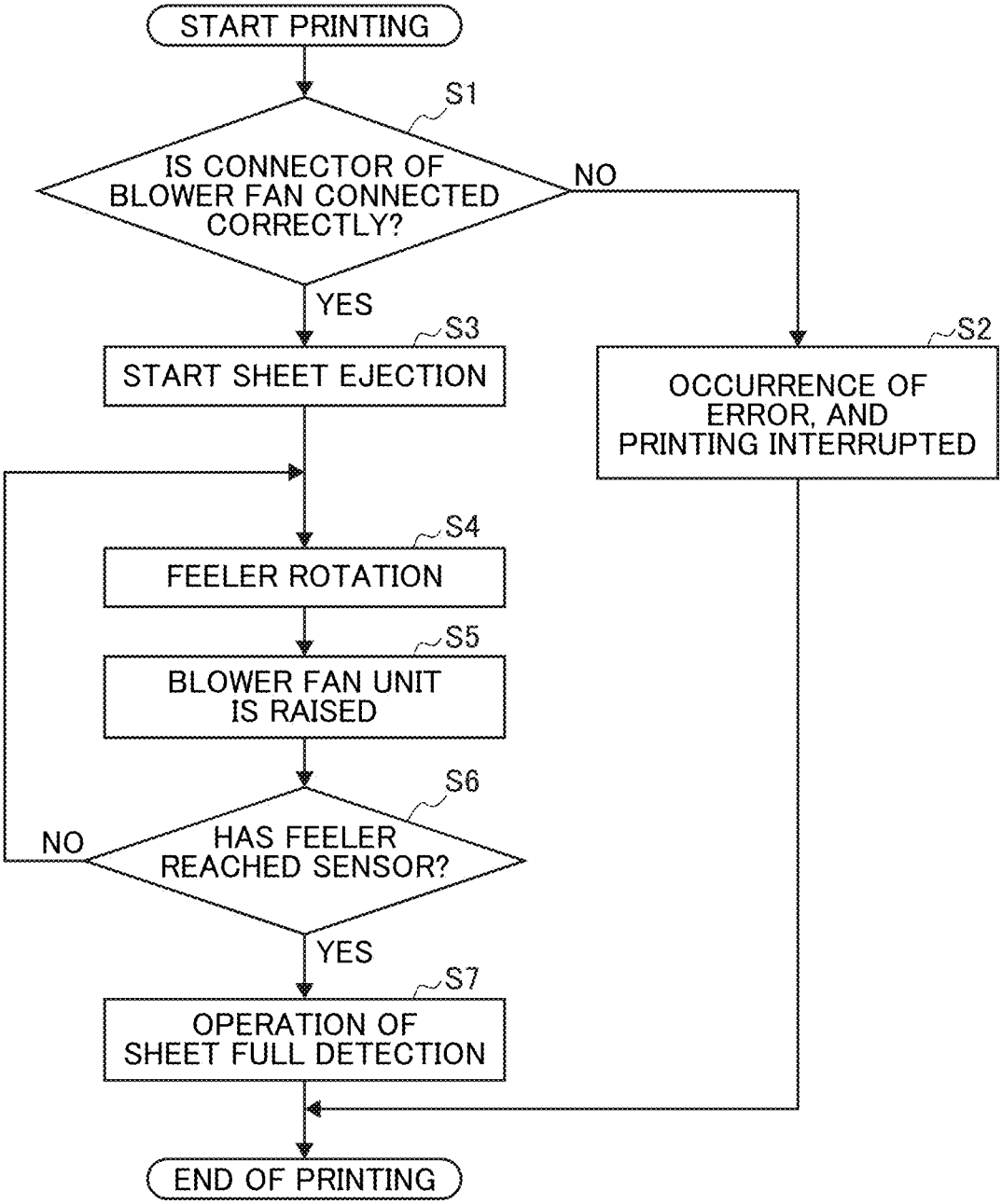
FIG. 15 is a flowchart illustrating operation of the image forming apparatus illustrated in FIG. 1.

FIG. 15 illustrates an example of operation of the image forming apparatus 500.

In step S1, the image forming apparatus 500 determines whether the connector 24 is correctly connected to the image forming apparatus 500.

In a case in which it is determined in step S1 that the connector 24 is not correctly connected, the image forming apparatus 500 displays, in step S2, a service call error on the operation unit 150 to interrupt printing.

In a case in which it is determined in step S1 that the connector 24 is correctly connected, the image forming apparatus 500 starts, in step S3, ejection of the sheet S onto the sheet ejection tray 10.

When the ejection of the sheet S is started, the feeler 31 rotates in step S4 in accordance with the stacking amount of the bundle of sheets S.

Figure 14:
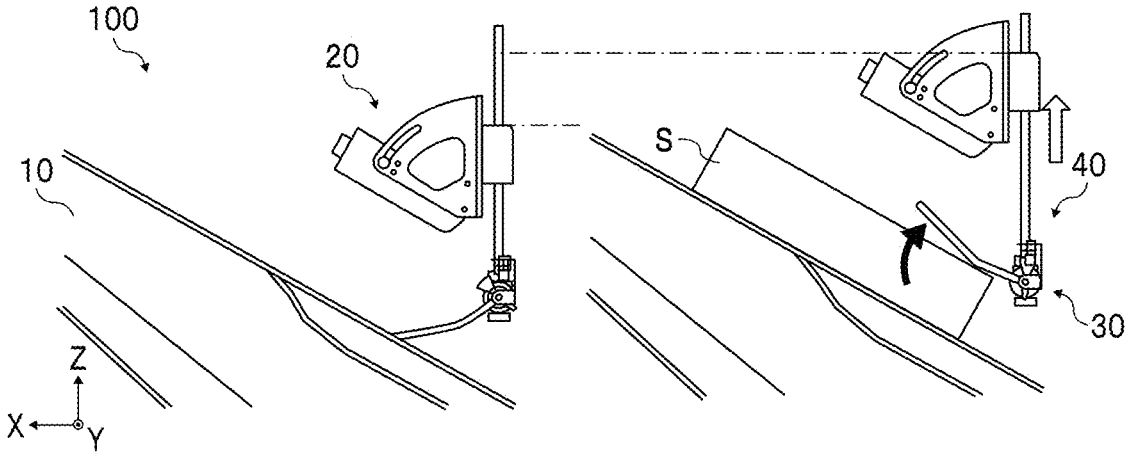
FIG. 14 is a front view illustrating up-down movement of a blower fan unit.

When the feeler 31 rotates, the rotation of the feeler 31 is transmitted, in step S5, to the blower fan unit 20 via the moving mechanism 40, and the blower fan unit 20 rises so as to move away from the sheet ejection tray 10 as illustrated in FIG. 14.

In step S6, the sensor 32 determines whether the feeler 31 reaches the sensor 32.

In a case in which it is determined in step S6 that the feeler 31 has not reached the sensor 32, the processing returns to step S4 and the feeler 31 further rotates in accordance with the stacking amount of the bundle of sheet S. In step S5, the blower fan unit 20 further rises by the rotation of the feeler 31. The operation of steps S4 and S5 is repeated until the feeler 31 reaches the sensor 32.

In a case in which it is determined in step S6 that the feeler 31 has reached the sensor 32, the image forming apparatus 500 detects, in step S7, that the sheet S is full on the sheet ejection tray 10, and the printing is finished.

The more the number of sheets S (i.e., the stacking amount of the bundle of sheets S) ejected onto the sheet ejection tray 10, the higher the likelihood of coming into contact with the blower fan 21 when removing the sheet S. In the present embodiment, the blower fan unit 20 rises in accordance with the stacking amount of the bundle of sheets S along with accumulation of the bundle of sheets S, making it possible to prevent occurrence of contact with the blower fan 21.

Moreover, the blower fan unit 20 moves to achieve the constant distance between the top surface of the bundle of sheets S stacked on the sheet ejection tray 10 and the blower fan 21, making it possible to easily remove the sheet S stacked on the sheet ejection tray 10 while obtaining the cooling effect.

Even when the sheet S or the hand of an operator or a user comes into contact with the blower fan 21 at the time of removing the sheet S, the blower fan 21 rotates along the grooves 22*a* and 22*b* to withdraw from the home position, suppressing hindrance of operation of removing the sheet S. Furthermore, the blower fan 21 withdrawn from the home position returns to the home position by the elastic force of the torsion springs 25*a* and 25*b* when the external force is gone, making it possible to save the trouble of returning the blower fan 21 to the home position, while maintaining the cooling performance.

While the preferred embodiments of this disclosure have been described above, this disclosure is not limited to such specific embodiments, and various modifications and alterations are possible within the scope and the spirit of this disclosure described in appended claims unless specified in particular.

For example, this disclosure can be applied to an image forming apparatus using an ink jet method. In the case of an image forming apparatus using an inkjet method, the blower fan is provided to face the sheet stacking surface on the sheet ejection tray for the purpose of drying the ink stuck to the sheet.

The effects described in the embodiment of this disclosure merely lists the most favorable effect arising from this disclosure and thus, the effects of this disclosure are not limited to the description in the embodiments of this disclosure.

Numerous additional modifications and variations are possible in light of the above teachings. It is therefore to be understood that, within the scope of the above teachings, this disclosure may be practiced otherwise than as specifically described herein. With some embodiments having thus been described, it will be obvious that the same may be varied in many ways. Such variations are not to be regarded as a departure from the scope of this disclosure and appended claims, and all such modifications are intended to be included within the scope of this disclosure and appended claims.

What is claimed is:

1. A sheet stacking device comprising:

a stacker on which at least one sheet is stacked;

a detector configured to detect a stacking amount of the at least one sheet on the stacker;

a blower configured to blow air to the at least one sheet stacked on the stacker, and to rotate with respect to the stacker; and a moving device including at least one gear, the moving device configured to, move the blower while maintaining a constant blowing angle of the blower with respect to the at least one sheet stacked on the stacker, and move the blower to change a distance between the blower and the stacker to achieve a constant distance between the blower and a top surface of the at least one sheet stacked on the stacker.

2. The sheet stacking device according to claim 1, wherein the detector includes a displacement body configured to, contact a top surface of the at least one sheet stacked on the stacker, and be displaced in accordance with the stacking amount of the at least one sheet; and the moving device includes a drive device, the drive device coupled to the displacement body, the drive device configured to drive the at least one gear of the moving device according to a displacement of the displacement body.

3. The sheet stacking device according to claim 1, further comprising:

a support attached to the blower, the support configured to support the blower in a state in which a distance of movement of the blower is changeable between the blower and the stacker.

4. The sheet stacking device according to claim 3, wherein the blower is biased to cause the blower to be set to a home position.

5. An image forming apparatus comprising:

a fixing device configured to fix an image on at least one sheet; and the sheet stacking device according to claim 1, wherein the at least one sheet to which the image has been fixed by the fixing device is stacked on the stacker.

6. A sheet stacking device comprising:

a stacker on which at least one sheet is stacked;

a detector configured to detect a stacking amount of the at least one sheet on the stacker, the detector including a displacement body, the displacement body configured to, contact a top surface of the at least one sheet stacked on the stacker, and be displaced in accordance with the stacking amount of the at least one sheet;

a blower configured to blow air to the at least one sheet stacked on the stacker, and to rotate with respect to the stacker; and a moving device including at least one gear, the moving device configured to move the blower while maintaining a constant blowing angle of the blower with respect to a top surface of the at least one sheet stacked on the stacker.

7. The sheet stacking device according to claim 6, further comprising:

the moving device including a drive device; and the drive device coupled to the displacement body, the drive device configured to drive the at least one gear of the moving device according to a displacement of the displacement body.

8. The sheet stacking device according to claim 6, wherein the moving device is further configured to move the blower to change a distance between the blower and the stacker to achieve a constant distance between the blower and a top surface of the at least one sheet stacked on the stacker.

9. The sheet stacking device according to claim 6, further comprising:

a support attached to the blower, the support configured to support the blower in a state in which a distance of movement of the blower is changeable between the blower and the stacker.

10. The sheet stacking device according to claim 9, wherein the blower is biased to cause the blower to be set to a home position.

11. The sheet stacking device according to claim 6, wherein the blower is configured to rotate when the at least one sheet contacts the blower.

12. An image forming apparatus comprising:

a fixing device configured to fix an image on at least one sheet; and the sheet stacking device according to claim 6, wherein the at least one sheet to which the image has been fixed by the fixing device is stacked on the stacker.

13. The sheet stacking device according to claim 3, wherein the support comprises:

at least one groove configured to allow a change of a blowing angle of the blower with respect to the at least one sheet stacked on the stacker.

14. The sheet stacking device according to claim 13, wherein the support further comprises:

at least one shoulder screw connected to the blower, the at least one shoulder screw moveable along the at least one groove; and at least one torsion spring attached to the at least one shoulder screw, the at least one torsion spring configured to apply stress to the blower and the support.

15. The sheet stacking device according to claim 4, wherein the blower is biased using a biasing device, the biasing device including at least one of:

a spring, a gel, a damper, or any combinations thereof.

16. The sheet stacking device according to claim 1, wherein the blower comprises:

a fan; and a motor configured to drive the fan to blow the air onto the at least one sheet stacked on the stacker.

17. The sheet stacking device according to claim 3, wherein the support comprises a fulcrum; and the blower is configured to rotate around the fulcrum in response to a number of sheets stacked on the stacker increasing.

18. The sheet stacking device according to claim 9, wherein the support further comprises:

at least one groove configured to allow a change of a blowing angle of the blower with respect to the at least one sheet stacked on the stacker.

19. The sheet stacking device according to claim 18, wherein the support further comprises:

at least one shoulder screw connected to the blower, the at least one shoulder screw moveable along the at least one groove; and at least one torsion spring attached to the at least one shoulder screw, the at least one torsion spring configured to apply stress to the blower and the support.

20. The sheet stacking device according to claim 10, wherein the blower is biased using a biasing device, the biasing device including at least one of:

a spring, a gel, a damper, or any combinations thereof.

* * * * *